US005562168A

United States Patent [19]

Rex

[11] Patent Number: 5,562,168

[45] Date of Patent: Oct. 8, 1996

[54] IMPACT HAMMER AND DRIVING TOOL

[75] Inventor: Albert E. Rex, Montacute, Australia

[73] Assignee: General and Railway Supplies Pty Ltd., South Australia, Australia

[21] Appl. No.: 508,085

[22] Filed: Jul. 27, 1995

Related U.S. Application Data

[63] Continuation of Ser. No. 905,184, Jun. 26, 1992, abandoned, which is a continuation of Ser. No. 713,372, Jun. 13, 1991, abandoned.

[51] Int. Cl.[6] ..... B25D 17/08; B25D 17/28

[52] U.S. Cl. ..... 173/30; 173/90; 173/114

[58] Field of Search ..... 173/30, 91, 162.1, 173/162.2, 114, 90

[56] References Cited

U.S. PATENT DOCUMENTS

| | | | |
|---|---|---|---|
| 502,565 | 8/1893 | Jones | 173/30 |
| 1,097,067 | 5/1914 | Unruh | 173/30 |
| 1,452,037 | 4/1923 | Gleasner | 173/30 |
| 2,165,904 | 7/1939 | Osgood | 173/30 |
| 2,723,835 | 11/1955 | Reese et al. | 173/30 |
| 4,280,540 | 7/1981 | Meacham | 173/91 |
| 5,095,600 | 3/1992 | Allan | 173/162.2 |

FOREIGN PATENT DOCUMENTS

| | | |
|---|---|---|
| 151143 | 5/1952 | Australia . |
| 6027 | 11/1967 | Australia . |
| WO8001367 | 7/1980 | WIPO . |

*Primary Examiner*—Scott A. Smith
*Attorney, Agent, or Firm*—Cushman, Darby & Cushman

[57] ABSTRACT

An impact hammer support 10 to be used in conjunction with an impact hammer 11 to aid in inserting a spike or fastener 12 into a wooden sleeper or cross tie 13. The support has a guide bushing 15 to slidably receive the driving tool 14. Attached to the bushing 15 is a bracket 19 which is pivotally supported by a foot pedal 23 to be engaged by the user. The impact hammer support 10 has the object of aiding in alignment of the impact hammer 11 with the spike or fastener 12.

10 Claims, 1 Drawing Sheet

IMPACT HAMMER AND DRIVING TOOL

This is a continuation of application Ser. No. 07/905,184, filed on Jun. 26, 1992, which was abandoned upon the filing hereof and which was a continuation of Ser. No. 07/713,372 filed Jun. 13, 1991, now abandoned.

FIELD OF THE INVENTION

The invention pertains to an impact hammer support and more particularly to a support which orients a specially adapted impact hammer driving tool when driving an insert or spike into a railway sleeper or cross tie.

1. Background Art

Impact hammers are used to drive fasteners, inserts and spikes into wooden sleepers. However, the impact hammer driving tool is hard to align precisely with the driven object. A glancing blow delivered by the hammer may careen the tool off the driven object. This slows down the work and in addition, the operator may be struck by the driving tool of the impact hammer.

2. Object of the Invention

It is an object of the invention to provide a support and specially adapted tool for an impact hammer which ameliorates the disadvantages of the prior art.

SUMMARY OF THE INVENTION

A support for an impact hammer comprises a guide bushing which is adapted to slidably receive a driving tool of an impact hammer. The guide bushing is secured by a clamping block which is retained by a bracket. The bracket is connected to a foot pedal.

The driving tool comprises a shaft having a driven end and a working end and a hilt between the driven end and the working end.

PREFERRED EMBODIMENT OF THE INVENTION

Figure 1:
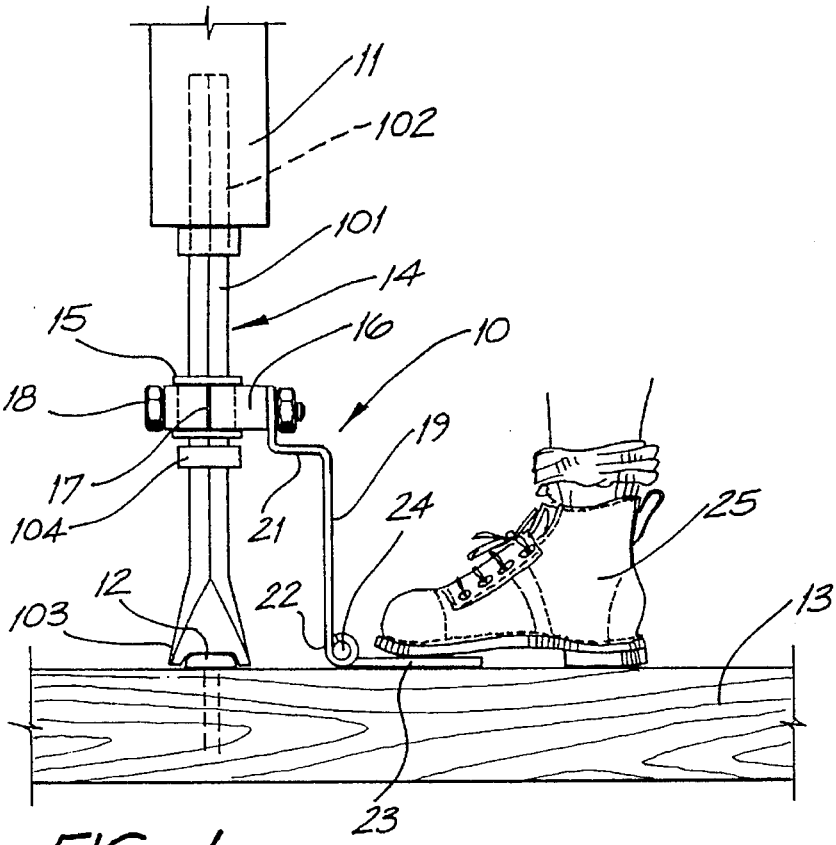
FIG. 1 shows a side elevation of an impact hammer operator utilizing the support of the present invention.

As shown in FIG. 1, a support 10 of the present invention may be used to orient an impact hammer 11 with respect to an insert, spike or fastener 12 which is being driven into a wooden sleeper or cross tie 13 which is used to support the rails of a railway. The impact hammer is generally pneumatically operated and includes a driving tool 14. The driving tool includes a shaft 101 having a driven end 102 and a working end 103. The tool 14 also includes a hilt 104 which is affixed to the shaft. The hilt may be formed integrally with the shaft, welded to it, or attached with fasteners. The hilt limits the upward travel of the shaft when it strikes the support. This stabilizes the tool 14 and distributes some of the load, otherwise taken by the operator's shoulders, to a foot pedal 23.

Figure 2:
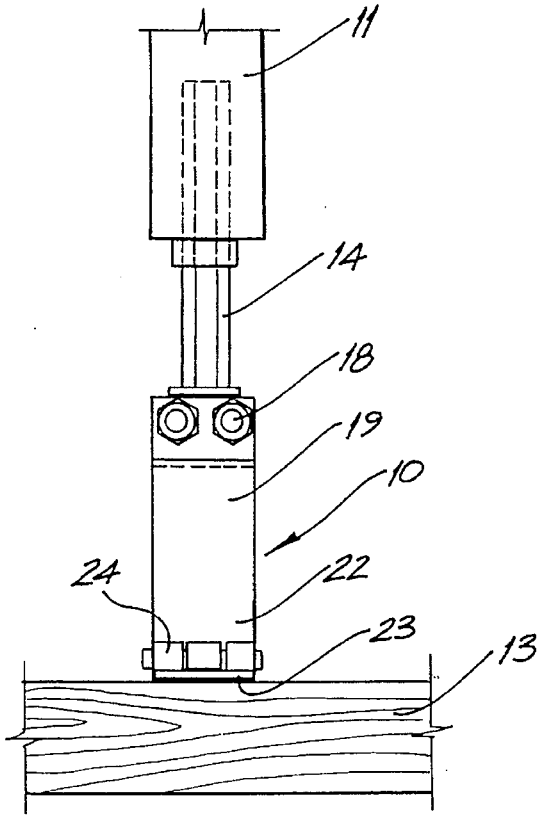
FIG. 2 shows in front elevation, the support of the present invention in conjunction with an impact hammer and driving tool.

The support 10 includes a guide bushing 15. The inside diameter of the guide bushing is sized to slidably receive the driving tool 14. The guide bushing is retained by a clamping block 16. The clamping block is split 17 into two halves. This allows the guide bushing to be serviced or replaced when necessary. The halves of the clamping block are attached and retained by threaded fasteners 18. As shown in FIG. 2, the clamping block is attached to a bracket 19. The attachment is preferably by means of the threaded fasteners 18. The bracket 19 includes an offset portion 21. The lower end 22 of the bracket is attached to a foot pedal 23 by a hinge 24. The operator of the impact hammer places a foot 25 on the foot pedal 23 to steady the support.

Because the outside diameter of the hilt 104 is larger than the inside diameter of the guide bushing 15, it will be understood that the tool is preferably inserted through the guide bushing by the driven end 102 first.

While the invention has been disclosed with reference to certain details of construction, these should be understood as having been provided by way of example and not as limitations to the scope of the invention as set forth in the claims.

What I claim is:

1. In combination:

an impact hammer support, an impact hammer, and an elongated tool, the impact hammer having a body which drives said elongated tool causing reciprocation of the tool, said tool having a proximal end mounted in said body, an exposed distal end for engaging an object to be driven by the tool and a shaft portion joining the distal and proximal ends, said support comprising:

a guide bushing having an inside diameter sized so that said shaft portion is slidably received therein to permit reciprocation of the shaft portion relative to the bushing;

a clamping block frictionally clamping a periphery of the guide bushing for retaining the guide bushing; and a bracket attached to the clamping block, the bracket extending from the clamping block to a foot pedal;

wherein said guide bushing engages said shaft portion at a position spaced from said distal end so that said distal end remains exposed thereby enabling an operator to see said distal end during use.

2. The support as claimed in claim 1, wherein the clamping block is divided into two portions for ease in servicing said guide bushing.

3. The support as claimed in claim 2, including threaded fasteners connecting the two portions of the clamping block.

4. The support as in claim 1, 2 or 3, wherein the bracket further comprises an offset portion to dispose a portion of said bracket away from the driving tool.

5. The support as claimed in claim 1, 2 or 3, including a hinge affixing said bracket to said foot pedal.

6. In combination:

an impact hammer, a support for the impact hammer, and an elongated tool, the impact hammer having a body which drives the elongated tool causing reciprocation of the tool along a longitudinal axis thereof, said tool having a proximal end mounted in said body, an exposed distal end for engaging an object to be driven by the tool and a shaft portion extending between the distal and proximal ends, said support comprising:

a guide bushing engaging the tool at a position spaced from said distal end and having an inside diameter sized for slidably receiving the tool shaft portion for guiding movement thereof along said longitudinal axis, said inside diameter defining a passage surrounding said tool, said passage having a longitudinal axis being coincident with the longitudinal axis of the tool;

bracket means attached to said guide bushing, said bracket means having a portion thereof extending from said guide bushing and being disposed in the direction of the longitudinal axis of said passage so as to extend longitudinally beyond said guide bushing toward said distal end to an attachment end; and a foot pedal attached to said portion of said bracket means at said attachment end and spaced from said guide bushing so that in use, said distal end of the tool remains exposed to thereby enable a user to see said distal end during use.

7. The combination as claimed in claim 6, wherein said foot pedal is pivotably attached to said portion of said bracket means for pivoting movement about an axis traverse to the longitudinal axis of said passage.

8. The combination as claimed in claim 6, wherein said bracket means comprises a coupling portion and said support further includes attachment means for securing the bushing to said coupling portion.

9. The combination as claimed in claim 8, wherein said attachment means projects laterally from said coupling portion so as to be located on one side of said bracket, said foot pedal being disposed on a side opposite said one side of said bracket.

10. The support as claimed in claim 9, wherein said attachment means comprises a clamp which frictionally engages said guide bushing to secure the bushing to said coupling portion.

* * * * *